US010222063B1

(12) United States Patent
Falkenhayn et al.

(10) Patent No.: US 10,222,063 B1
(45) Date of Patent: Mar. 5, 2019

(54) WATERPROOF LIGHTER CASE

(71) Applicant: EXOTAC, INC., Winder, GA (US)

(72) Inventors: Robert A. Falkenhayn, Hoschton, GA (US); Colin D. Reilly, Lawrenceville, GA (US)

(73) Assignee: Exotac, Inc., Winder, GA (US)

( * ) Notice: Subject to any disclaimer, the term of this patent is extended or adjusted under 35 U.S.C. 154(b) by 716 days.

(21) Appl. No.: 14/871,307

(22) Filed: Sep. 30, 2015

Related U.S. Application Data

(60) Provisional application No. 62/057,681, filed on Sep. 30, 2014.

(51) Int. Cl.

| | |
|---|---|
| ***F23Q 2/40*** | (2006.01) |
| ***F23Q 2/50*** | (2006.01) |
| ***B65D 25/22*** | (2006.01) |
| ***B65D 41/02*** | (2006.01) |

(52) U.S. Cl.
CPC ..... *F23Q 2/50* (2013.01); *B65D 25/22* (2013.01); *B65D 41/02* (2013.01); *F23Q 2/40* (2013.01)

(58) Field of Classification Search
CPC ..... F23Q 2/36; F23Q 2/50
USPC ..... 220/359.1; 431/142
See application file for complete search history.

(56) References Cited

U.S. PATENT DOCUMENTS 4,330,954 A * 5/1982 Lonsmin ..... F23Q 2/36 40/486
2008/0138752 A1* 6/2008 Maruyama ..... F23Q 2/287 431/249

FOREIGN PATENT DOCUMENTS

FR 2731591 A1 * 9/1996 ..... A24F 15/18
WO WO 2006048468 A1 * 5/2006 ..... F23Q 2/36

* cited by examiner

*Primary Examiner* — Avinash A Savani
*Assistant Examiner* — Aaron H Heyamoto
(74) *Attorney, Agent, or Firm* — Eversheds Sutherland (US) LLP

(57) ABSTRACT

A case for a lighter including a removable cap and elongated body sleeve is described herein. Placing the cap on the elongated body sleeve creates a waterproof seal that protects the components of the lighter inside of the case and prevents exposure of the lighter to moisture that may damage components or prevent proper functioning of the lighter. The case can prevent inadvertent activation of the gas button and can also provide a gas lock strap for selectively activating and maintaining activation of the gas button. The case and cap can include features for increasing grip on the lighter as well as removably coupling the case to a lanyard, key ring, or other means of retention.

13 Claims, 6 Drawing Sheets

WATERPROOF LIGHTER CASE

CROSS-REFERENCE TO RELATED APPLICATIONS

The present application claims priority to and the benefit of U.S. Provisional Patent Application No. 62/057,681, filed on Sep. 30, 2014, entitled "WATERPROOF LIGHTER CASE," which is hereby incorporated by reference in its entirety.

FIELD OF THE DISCLOSURE

This disclosure generally relates to lighter cases. More particularly, this disclosure relates to waterproof lighter cases.

BACKGROUND

Lighters are commonly carried and used for various purposes, including smoking, lighting barbeques, and staring fires. While using a lighter, it is possible for a lighter to get wet unintentionally by being dropped in water, having water spilled on the lighter, or by being exposed to weather conditions. In these cases, the lighter may become unusable due to mechanisms that will no longer function when wet. It is also possible for the lighter components to corrode if exposed to moisture for a period of time. For this reason, a waterproof case allows for a practical solution to this problem It is also possible, while carrying a disposable lighter, for the gas button to be pressed while in a pocket or a pack which may result in the fuel emptying and the lighter becoming unusable.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION OF THE EXAMPLE EMBODIMENTS

Figure 1:
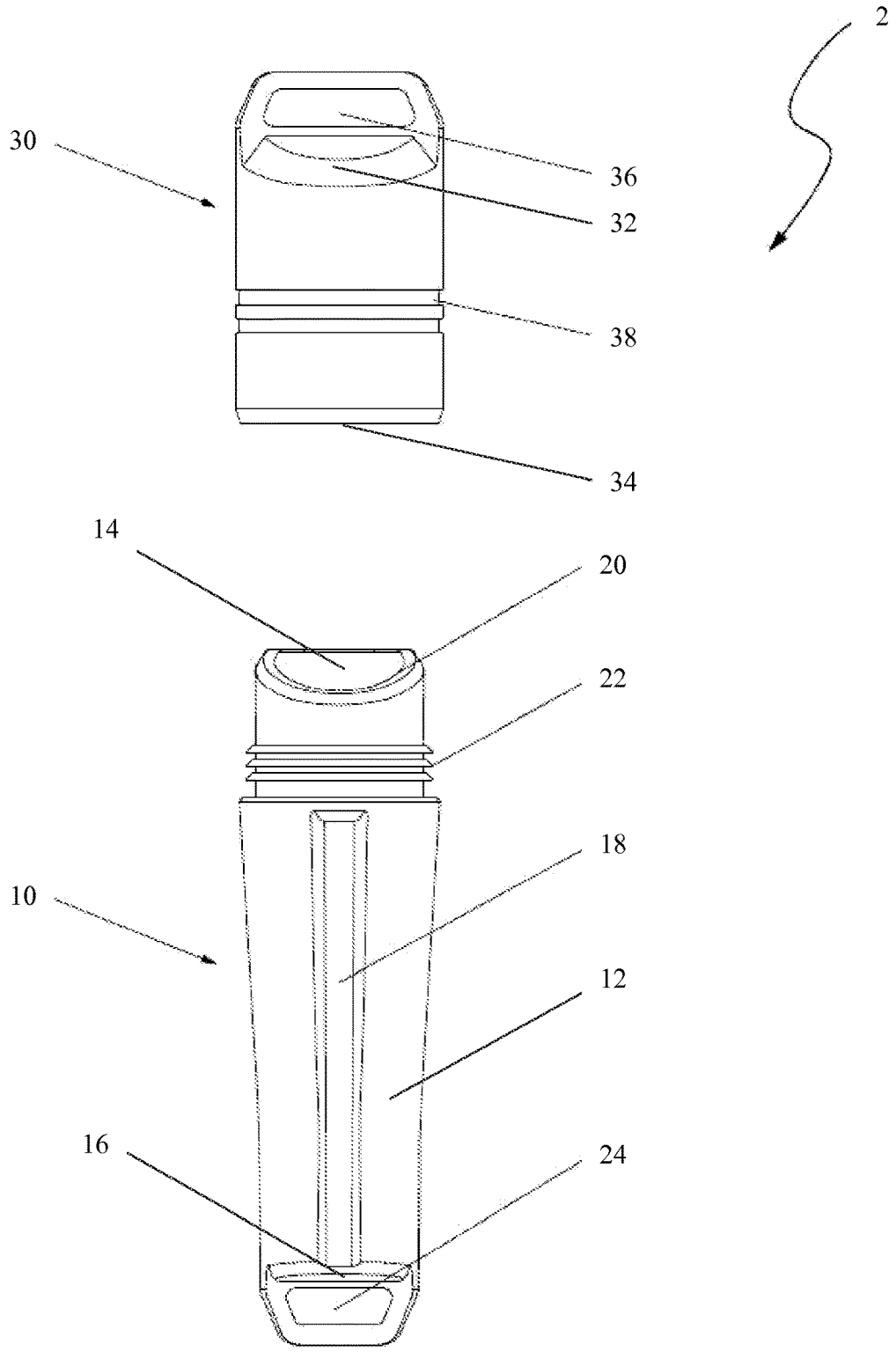
FIG. 1 illustrates a front view of a waterproof lighter case in accordance with one or more embodiments of the disclosure.
Figure 2:
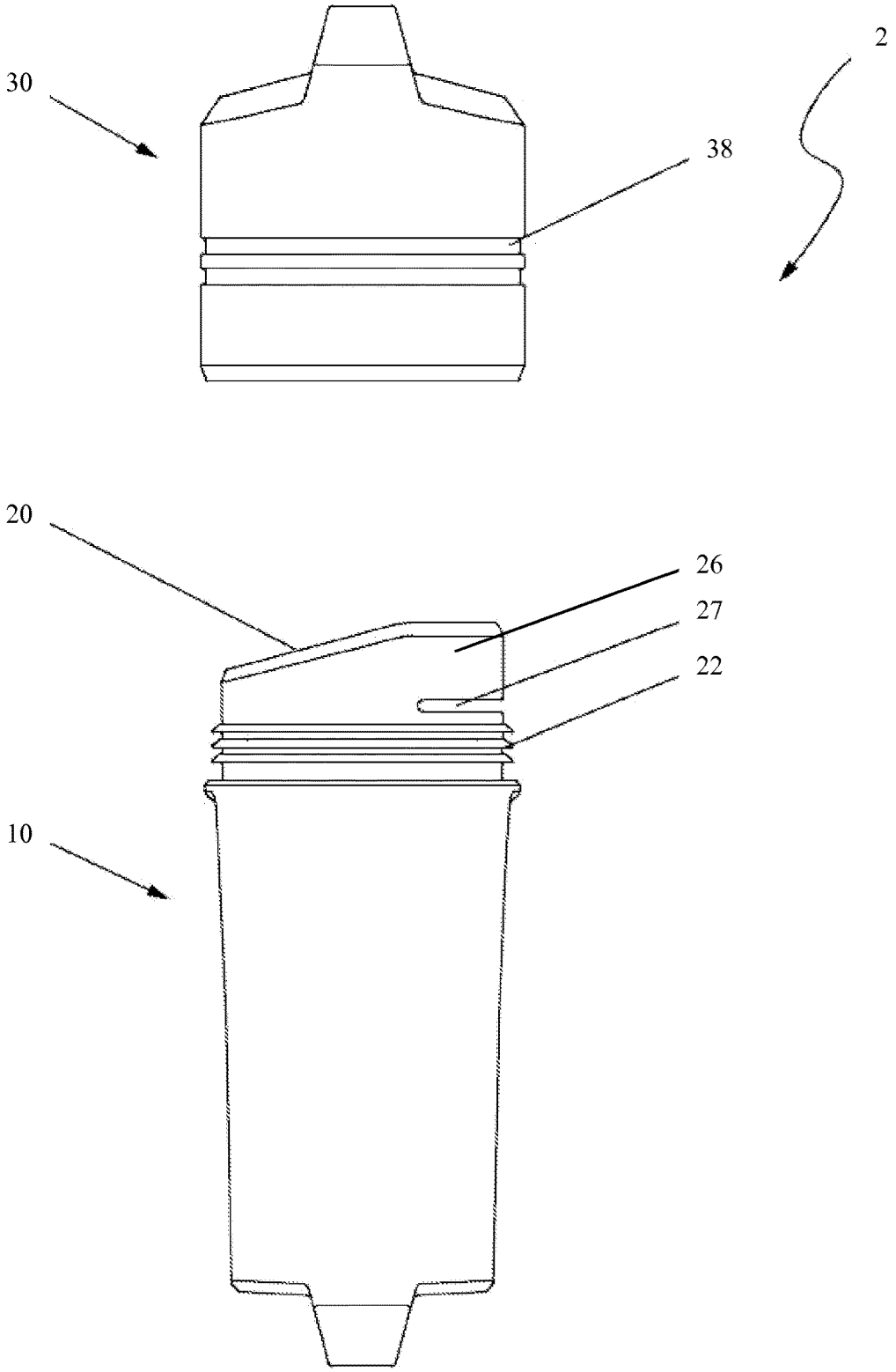
FIG. 2 illustrates a side view of a waterproof lighter case in accordance with one or more embodiments of the disclosure.

Exemplary embodiments will now be described more fully hereinafter with reference to the accompanying drawings, in which exemplary embodiments are shown. The concepts disclosed herein may, however, be embodied in many different forms and should not be construed as limited to the exemplary embodiments set forth herein; rather, these embodiments are provided so that this disclosure will be thorough and complete, and will fully convey the scope of the concepts to those skilled in the art. Like numbers refer to like, but not necessarily the same or identical, elements throughout.

FIGS. 1 thru 4 depict a waterproof lighter case 2 composed of a sleeve 10, which covers the body of a lighter while leaving the top exposed for use, and a cap 30, which may be pressed onto the top of the sleeve 10 for storage. The case has a sleeve that comprises a surrounding body 12 open at first end 14, for receiving the body of a lighter, and is substantially closed at a second end 16. The case also includes a cap 30 which has a substantially closed end 32, and an open end 34 configured to mate with the open end 14 of the sleeve, and create a watertight seal by a frictional relationship between the exterior surface of the open first end of the sleeve and the interior surface of the open end of the cap 30.

In further detail, FIG. 1, depicts the sleeve 10, open at the first end 14 for receiving the body of a lighter, and a cap 30 which has an open end 34 configured to mate with the open end of the sleeve 14. The frictional relationship between the interior surface of the cap 30 and the exterior surface of the sleeve 10 creates a watertight seal. In one exemplary embodiment, the sleeve may comprise crush ribs 22 disposed about, and adjacent to, the opening of the sleeve 10. The crush ribs 22 may comprise a thin protrusion of soft material that extends radially outward from the outer surface of the sleeve 10 and may allow for deflection and compression when force is exerted on them, improving the watertight seal with the cap 30. The lighter may be held tight in the sleeve 10, which may be made of a semi-flexible material, by friction exerted on the lighter by the sleeve 10 which may expand to fit the lighter for a tight fit. Flexibility of the sleeve may be helped by the expansion grooves 18 which allow the sleeve 10 to expand easily to receive the lighter and may also increase grip. The sleeve 10 has a relief 20 at the top which keeps the material from coming in contact with the flame or heat generated by the flame. The cap 30 may also include one or more grooves 38 that extend radially inward from the outer surface of the cap 30 to increase grip. In certain examples, the grooves may be disposed in parallel about the outer surface of the cap 30 and may define an outward extending rib of cap material therebetween. In addition, the cap 30 may include a cap attachment point 36 and a sleeve attachment point 24, each of which may define an opening or passageway through a portion of at least part of the corresponding cap 30 or sleeve 10, which creates a secure attachment point for a key ring, lanyard or other attachment.

The cap 30 may be made of metal or durable plastic that is strong enough to protect the top of the lighter. The sleeve 10 may be made of a soft, pliable, elastic or semi-elastic plastic material, soft enough to expand and create a tight fit between the lighter and the sleeve when the lighter is inserted into the sleeve 10. The sleeve 10 may be soft enough to allow the crush ribs 22 to create a tight seal between the cap 30 and the body of the lighter.

Figure 3:
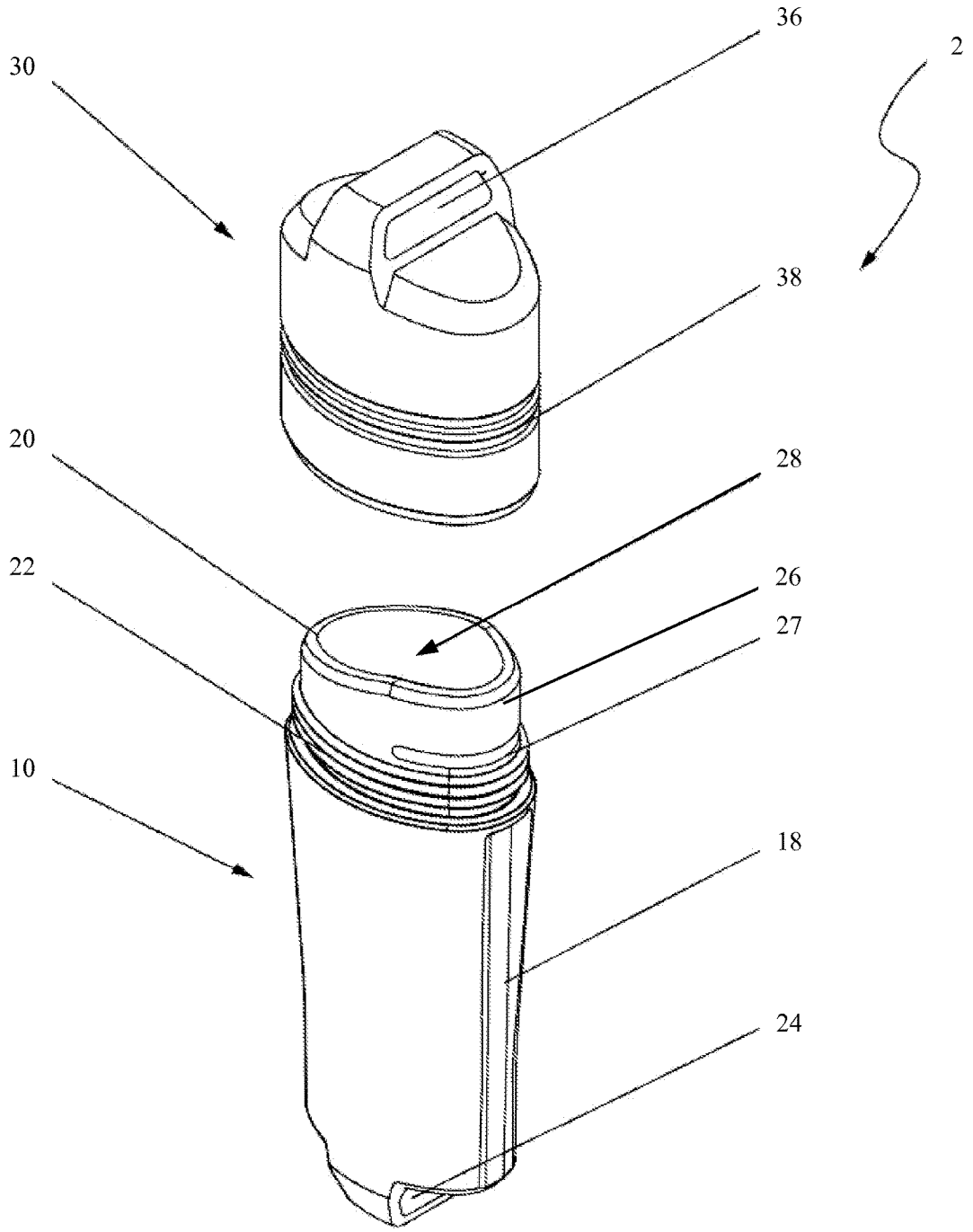
FIG. 3 illustrates a top perspective view of a waterproof lighter case in accordance with one or more embodiments of the disclosure.

FIG. 3 depicts the cavity 28 in the sleeve 10 which may be designed to fit the exact profile of a BIC® Classic lighter, but may be modified to fit the profile of any currently produced or future produced lighter. The gas lock strap 26, which is adjacent to the opening of the sleeve, is configured to selectively actuate the gas button of the lighter. The gas lock strap 26 is separated from the sleeve by a slot 27 and may be pulled up and over the gas button on a BIC® Classic lighter, or the like. The gas lock strap 26 may be able to stay on the button without any human intervention once in place. The gas lock strap 26, in one example, may be integrally formed with the sleeve 30. In another exemplary embodiment the gas lock strap 26 may be pivotally attached to the sleeve 30. In yet another exemplary embodiment the gas lock strap 26 may be formed by cutting a slit into the sleeve 10.

The gas lock strap 26 may be formed as a part of the sleeve 10 and made of a resilient and moisture repellent material, such as a rubber or plastic. It has been found that a thickness on the order of 0.095 inch, or approximately 3/32 inch, with the relief being 0.32 inch, or approximately 5/16 inch, from the top works well when molded as part of the sleeve 10, providing the desired flexibility to allow the gas lock strap to be fit securely over the gas button and apply a pressure to the gas button sufficient to actuate the gas button.

The gas lock strap 26 may also be formed into different shapes and/or material so that it does not apply pressure to the gas button, but rather, prevents the actuation of the gas button of the lighter.

In another embodiment, the gas lock strap 26 may be moved from the first position to a second position by rotating up on the gas lock strap 26, or by other means to move the strap into a locking position over the gas button. For example, the gas lock strap 26 may be attached at one or more pivot points on the sleeve 10 allowing the gas lock strap 26 to pivot between an initial position on the sleeve to a second position over the gas button of the lighter in order to actuate the gas button.

Figure 4:
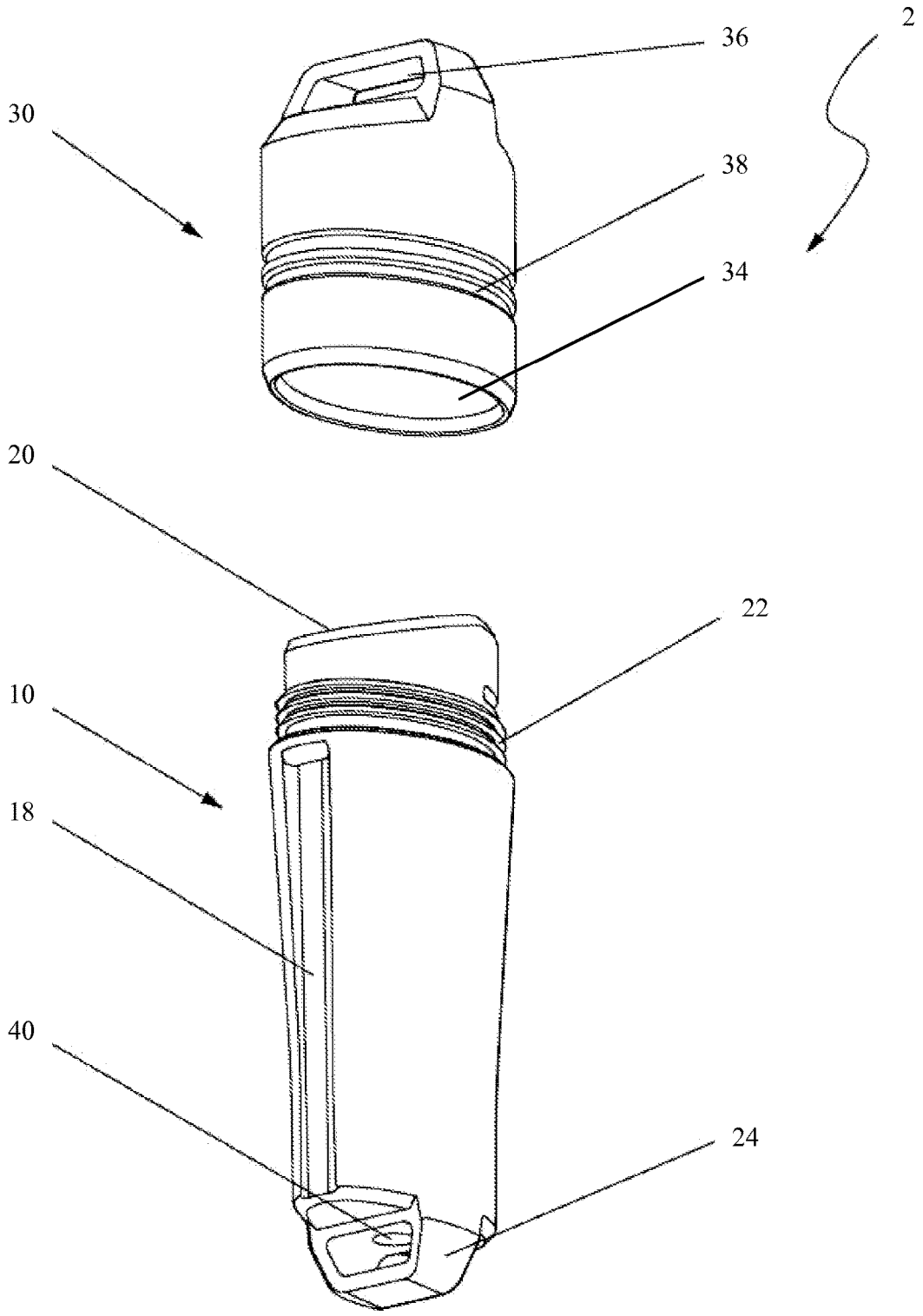
FIG. 4 illustrates a bottom perspective view of a waterproof lighter case in accordance with one or more embodiments of the disclosure.

FIG. 4 depicts a pressure relief hole 40 positioned in the bottom of the sleeve 10. In one example, the pressure relief hole 40 aids in the manufacturing of the sleeve 10, as well as providing a relief hole for air as the lighter is pressed into the sleeve 10 to allow it to be fully pressed onto the body of the lighter. Alternatively, other openings, such as slits, slots, flaps, or other similar elements, may be used.

Figure 5:
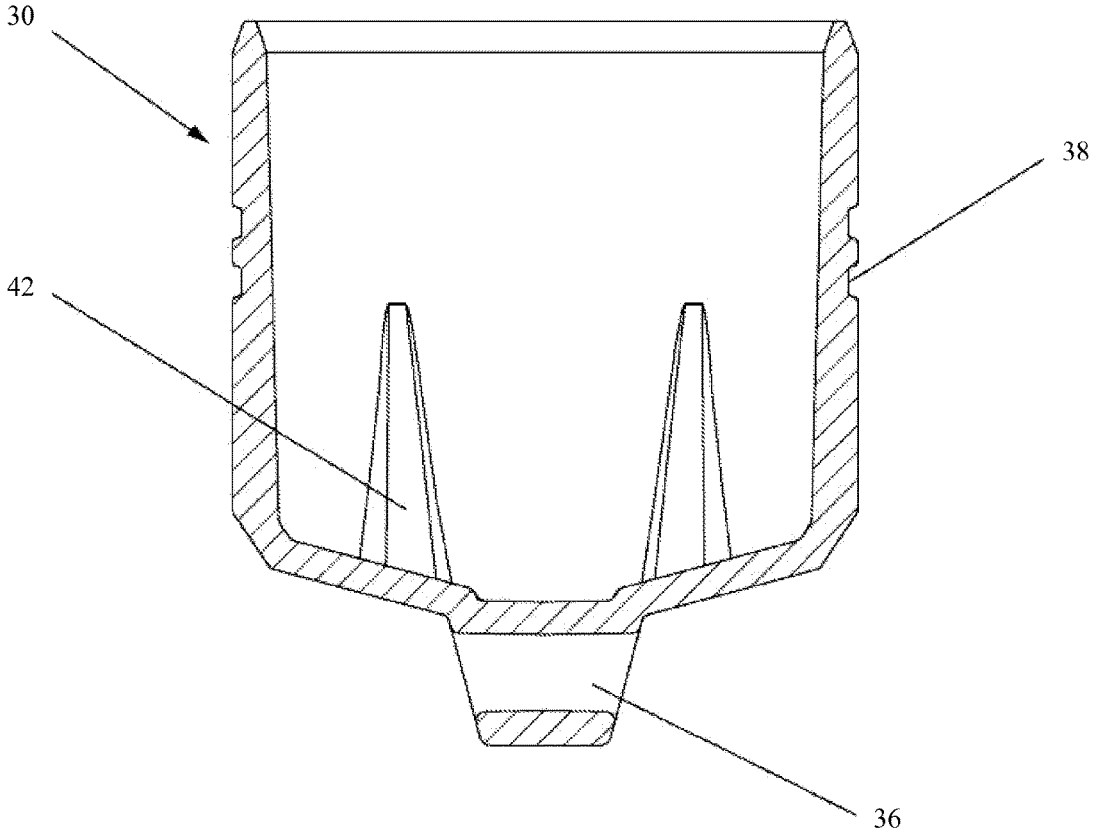
FIG. 5 illustrates a cross section view of the cap of a waterproof lighter case in accordance with one or more embodiments of the disclosure.

FIG. 5 depicts the interference ribs 42 on the interior surface of the cap 30. In one example, the sleeve 10 and cap 30 are configured so that the cap 30 may be placed on the closed second end 16 of the sleeve 10 while the lighter is in use. When placed on the second end 16 of the sleeve 10, the interference ribs 42 contact the exterior surface of the sleeve 10. The interference ribs 42 provide added friction to the cap 30 when it is being retained on the bottom of the sleeve 10 in a manner similar to that of removable caps for ballpoint pens. As should be recognized by those of ordinary skill in the pertinent art, the interference ribs 42 may take other forms including circumferential ribs or other shapes that are capable of performing the function of the interference ribs as described herein.

Figure 6A:
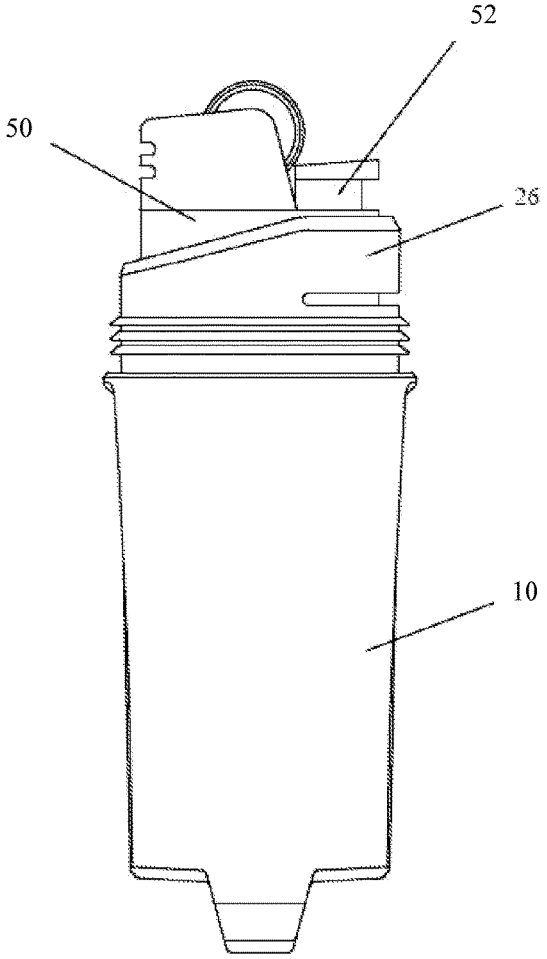
FIGS. 6A and 6B illustrate a side view showing the gas lock in use of a waterproof lighter case in accordance with one or more embodiments of the disclosure.
Figure 6B:
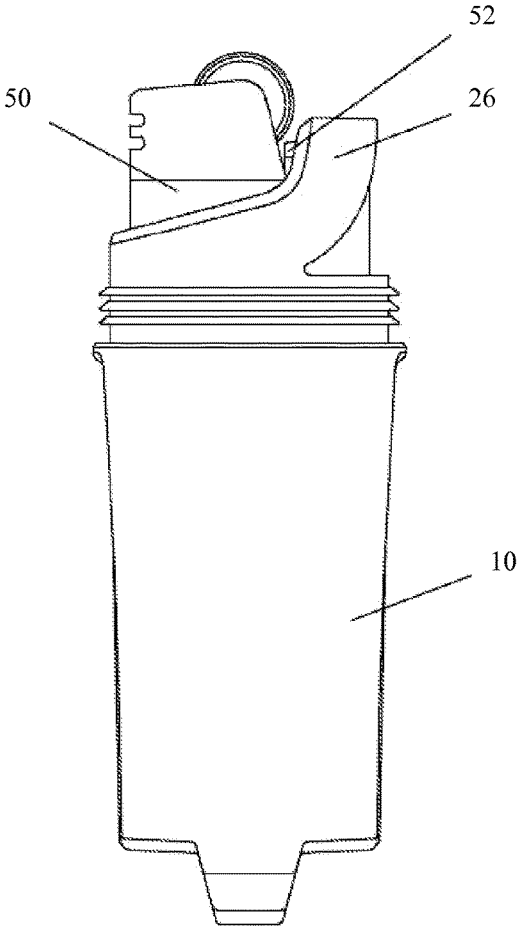

FIGS. 6A & 6B depict the lighter 50 inserted into the sleeve 10. FIG. 6A depicts the gas lock strap 26 in an initial, normal position, when it is not in use with the gas button 52 of the lighter 50. FIG. 6B depicts the gas lock strap 26 in use where the strap 26 has been pulled up and over the gas button 52 on the lighter 50. The friction between the strap material and the gas button 52 prevents the strap from slipping off while creating enough pressure to keep the gas button 52 down. In another embodiment, for example, the gas lock strap 26 can be pivotally attached to the sleeve as described herein to move from the first position to the second position and engage the gas button 52.

In an example embodiment, the present disclosure is a waterproof case for a lighter that protects all important components from moisture and damage and keeps the gas button from accidently being depressed while adding grip, and a mechanism to keep the lighter lit without having to manually press the gas button.

Conditional language, such as, among others, "can," "could," "might," or "may," unless specifically stated otherwise, or otherwise understood within the context as used, is generally intended to convey that certain implementations could include, while other implementations do not include, certain features, elements, and/or operations. Thus, such conditional language generally is not intended to imply that features, elements, and/or operations are in any way required for one or more implementations or that one or more implementations necessarily include logic for deciding, with or without user input or prompting, whether these features, elements, and/or operations are included or are to be performed in any particular implementation.

Many modifications and other implementations of the disclosure set forth herein will be apparent having the benefit of the teachings presented in the foregoing descriptions and the associated drawings. Therefore, it is to be understood that the disclosure is not to be limited to the specific implementations disclosed and that modifications and other implementations are intended to be included within the scope of the appended claims. Although specific terms are employed herein, they are used in a generic and descriptive sense only and not for purposes of limitation.

What is claimed is:

1. A waterproof case for a lighter having an elongated body with a gas button for maintaining a lighter in an on position, the waterproof case comprising:

an elongated sleeve, wherein the elongated sleeve comprises a surrounding body comprising a first open end defining an opening to a cavity for receiving a body of the lighter and a substantially closed second end, wherein the elongated sleeve comprises a gas lock strap disposed adjacent to the opening of the elongated sleeve and configured to selectively actuate the gas button of the lighter, wherein gas lock strap is formed by a slit cut into and through a portion of the surrounding body of the elongated sleeve, wherein the gas lock strap is configured to be stretched over the gas button of the lighter to keep the gas button of the lighter in a depressed position, and wherein the elongated sleeve comprises an attachment point for removably coupling to a lanyard, key ring, or other means of retention, and a cap removably coupled to the elongated sleeve, the cap comprising an open end defining an opening to a cap cavity and configured to be removably coupled to the first open end of the elongated sleeve, wherein the cap creates a seal with a frictional relationship with the first open end of the elongated sleeve.

2. The waterproof lighter case of claim 1, wherein the elongated sleeve comprises a first slit in the surrounding body and disposed adjacent to the gas lock strap, wherein the gas lock strap is movable between a first position separated from the first end by the first slit and a second position disposed across and actuating the gas button of the lighter received in the elongated sleeve.

3. The waterproof lighter case of claim 1, wherein the gas lock strap is integrally formed with the elongated sleeve.

4. The waterproof lighter case of claim 1, wherein the gas lock strap is pivotally coupled to the elongated sleeve.

5. The waterproof lighter case of claim 1, wherein the elongated sleeve comprises at least one crush rib disposed adjacent to the first open end and extending radially out from the surrounding body of the elongated sleeve disposed about and adjacent to the opening of the elongated sleeve.

6. The waterproof lighter case of claim 5, wherein the crush rib comprises a thin protrusion of pliable material.

7. The waterproof lighter case of claim 1, wherein the surrounding body of the elongated sleeve comprises one or more sections of thicker material and one or more sections of thinner material running along at least a portion of a longitudinal axis of the surrounding body, wherein the thinner material is more pliable that the thicker material and allows for the expansion of the surrounding body to achieve a seal to the body of the lighter.

8. The waterproof lighter case of claim 1, wherein the cap comprises an interior surface comprising a first diameter and a second diameter, wherein the first diameter is less than the second diameter and is configured to increase the amount of friction between the cap and the elongated sleeve when the cap is coupled to the elongated sleeve.

9. The waterproof lighter case of claim 1, wherein the cap further comprises at least one groove cut into an outer surface of the cap and disposed circumferentially about the outer surface of the cap.

10. The waterproof lighter case of claim 1, wherein the cap further comprises a plurality of grooves, wherein the plurality of grooves are disposed in parallel about the outer surface of the cap.

11. The waterproof lighter case of claim 1, wherein the cap further comprises an attachment point for removably coupling to a lanyard, key ring, or other means of retention.

12. The waterproof lighter case of claim 1, wherein coupling the cap to the elongated sleeve creates a water-tight seal between the cap and the elongated sleeve.

13. A waterproof case for a lighter having an elongated body with a gas button for maintaining a lighter in an on position, the waterproof case comprising:

an elongated sleeve, wherein the elongated sleeve comprises a surrounding body comprising a first open end defining an opening to a cavity for receiving a body of the lighter and a substantially closed second end, wherein the elongated sleeve comprises a gas lock strap disposed adjacent to the opening of the elongated sleeve and configured to selectively actuate the gas button of the lighter, wherein gas lock strap is formed by a slit cut into and through a portion of the surrounding body of the elongated sleeve, wherein the gas lock strap is configured to be stretched over the gas button of the lighter to keep the gas button of the lighter in a depressed position, and a cap removably coupled to the elongated sleeve, the cap comprising an open end defining an opening to a cap cavity and configured to be removably coupled to the first open end of the elongated sleeve, wherein the cap creates a seal with a frictional relationship with the first open end of the elongated sleeve, and wherein the cap comprises an attachment point for removably coupling to a lanyard, key ring, or other means of retention.

* * * * *